US011047161B2

(12) United States Patent
Holzapfel

(10) Patent No.: US 11,047,161 B2
(45) Date of Patent: Jun. 29, 2021

(54) FURNITURE DRIVE

(71) Applicant: Julius Blum GmbH, Hoechst (AT)

(72) Inventor: Andreas Holzapfel, Bregenz (AT)

(73) Assignee: Julius Blum GmbH, Hoechst (AT)

( * ) Notice: Subject to any disclaimer, the term of this patent is extended or adjusted under 35 U.S.C. 154(b) by 17 days.

(21) Appl. No.: 16/667,260

(22) Filed: Oct. 29, 2019

(65) Prior Publication Data

US 2020/0063483 A1 Feb. 27, 2020

Related U.S. Application Data

(63) Continuation of application No. PCT/AT2018/000044, filed on May 8, 2018.

(30) Foreign Application Priority Data

May 12, 2017 (AT) ..... A 50406/2017

(51) Int. Cl.
*E05D 15/40* (2006.01)
*E05F 1/12* (2006.01)
(Continued)

(52) U.S. Cl.
CPC ..... *E05D 15/40* (2013.01); *E05D 3/06* (2013.01); *E05F 1/1058* (2013.01); *E05F 1/1253* (2013.01); *E05Y 2900/20* (2013.01)

(58) Field of Classification Search
CPC ..... E05F 1/1253; E05F 1/1261; E05F 3/227; E05F 1/1058; E05D 3/06; E05D 15/40
See application file for complete search history.

(56) References Cited

U.S. PATENT DOCUMENTS 8,011,741 B2 * 9/2011 Mattle ..... E05F 15/63 312/319.5
8,376,480 B2 * 2/2013 Brunnmayr ..... E05D 3/06 312/323
(Continued)

FOREIGN PATENT DOCUMENTS

CN 103415671 11/2013
CN 105101843 11/2015
(Continued)

OTHER PUBLICATIONS

International Search Report dated Aug. 20, 2018 in International (PCT) Application No. PCT/AT2018/000044.
(Continued)

*Primary Examiner* — Jeffrey O'Brien
(74) *Attorney, Agent, or Firm* — Wenderoth, Lind & Ponack, L.L.P.

(57) ABSTRACT

A furniture drive for moving a furniture part movably supported relative to a furniture carcass the furniture drive includes a housing having a first housing wall to be fixed to the furniture carcass, and a second housing wall at least partially spaced from the first housing wall. At least the first housing wall includes a guide device for guiding a fastener. At least one supporting body is configured so as to be separate from the guide device for guiding the fastener, at least partially surrounds the guide device, and is firmly connected to the first housing wall as well as to the second housing wall so that a movement of the second housing wall relative to the first housing wall is restrained.

17 Claims, 5 Drawing Sheets

(51) Int. Cl.
*E05F 1/10* (2006.01)
*E05D 3/06* (2006.01)

(56) References Cited

U.S. PATENT DOCUMENTS

| | | | | |
|---|---|---|---|---|
| 8,696,076 | B2 * | 4/2014 | Karg | A47B 46/00 312/323 |
| 8,959,709 | B2 * | 2/2015 | Hasegawa | E05F 1/1261 16/65 |
| 9,140,289 | B2 * | 9/2015 | Sutterluetti | F16B 35/041 |
| 9,181,743 | B2 * | 11/2015 | Kashiwaguma | E05D 15/40 |
| 9,277,815 | B2 * | 3/2016 | Brunnmayr | A47B 88/49 |
| 9,506,283 | B2 * | 11/2016 | Folie | E02D 5/80 |
| 9,719,283 | B2 * | 8/2017 | Holzapfel | A47B 96/00 |
| 10,240,375 | B2 * | 3/2019 | Brunnmayr | E05F 15/60 |
| 10,294,705 | B2 * | 5/2019 | Hirtsiefer | E05D 3/16 |
| 10,494,846 | B2 * | 12/2019 | Schmid | E05D 15/40 |
| 10,508,673 | B2 * | 12/2019 | Haemmerle | E05F 1/00 |
| 2013/0333291 | A1 * | 12/2013 | Blum | E06B 3/385 49/386 |
| 2013/0334944 | A1 * | 12/2013 | Karg | E05D 15/44 312/237 |
| 2014/0169912 | A1 * | 6/2014 | Sutterluetti | F16B 12/14 411/389 |
| 2015/0361705 | A1 * | 12/2015 | Folie | E05F 1/1058 312/319.6 |
| 2016/0007749 | A1 | 1/2016 | Brunnmayr | |
| 2020/0063484 | A1 * | 2/2020 | Haemmerle | E05F 5/10 |
| 2020/0256101 | A1 * | 8/2020 | Holzapfel | E05D 13/00 |

FOREIGN PATENT DOCUMENTS

| | | |
|---|---|---|
| DE | 10 2007 049 143 | 6/2008 |
| DE | 20 2010 014 948 | 3/2012 |
| DE | 20 2016 101 285 | 4/2016 |
| EP | 2 964 860 | 4/2018 |
| JP | 2007-309005 | 11/2007 |
| JP | 2014-525551 | 9/2014 |
| JP | 2016-509143 | 3/2016 |
| WO | 2013/029070 | 3/2013 |
| WO | 2017/059471 | 4/2017 |

OTHER PUBLICATIONS

Search Report dated Sep. 24, 2020 in counterpart Chinese Patent Application No. 201880031299.3.
English Translation of Text Portion of the Notification of the Second Office Action dated Feb. 20, 2021 by the China National Intellectual Property Administration; 86771/BZ; IIM93453, pp. 1-3.
Blockley, R. and Shyy, W., "Structure Technology", 2016, pp. 2-3.

* cited by examiner

FURNITURE DRIVE

BACKGROUND OF THE INVENTION

The present invention relates to a furniture drive for moving a furniture part movably supported relative to a furniture carcass, the furniture drive comprising a housing having a first housing wall to be fixed to a furniture carcass and a second housing wall which is at least partially spaced from the first housing wall. At least the first housing wall includes at least one guide device for guiding a fastening means.

The invention further concerns an item of furniture comprising a furniture carcass, a furniture part movably supported relative to the furniture carcass and a furniture drive of the type to be described.

WO 2017/059471 A shows in FIGS. 5*a*, 5*b* a furniture fitting in the form of a furniture drive for moving furniture flaps, and the furniture fitting can be mounted to a furniture carcass by a fastening device. The fastening device includes at least two fastening elements configured to be inserted into a common cylindrical bore. By rotating an arresting element, the fastening elements can be moved into an expanded position, so that the fastening elements, in the expanded position, are held within the bore in a force-locking manner.

DE 20 2016 101 285 U1 discloses a furniture drive for moving furniture flaps, in which the furniture drive includes a recess for receiving a pin. In a first mounting step, the pin is pre-mounted to a furniture carcass, and, in a subsequent mounting step, the furniture drive is locked to the pin by introducing the pre-mounted pin into the recess, whereby the furniture drive can be fixed to the furniture carcass.

DE 10 2007 049 143 A1 discloses a furniture fitting to be mounted to a chipboard plate. A supporting body is arranged in an expanded space of the furniture fitting, the expanded space being configured so as to broaden towards the chipboard plate. The supporting body is configured to receive a screw and rests against the chipboard plate in the mounted condition, so that in a region of the expanded space, the danger of tearing out the screw and a breaking out of the wood material from the chipboard plate can be reduced.

The housing of such furniture drives is usually mounted to a furniture carcass by fastening means, for example by screws. For this purpose, the housing of the furniture drive includes a guide device (for example a hole or a cylindrical portion) for guiding and/or receiving the fastening means. Upon screwing the housing to the furniture carcass and/or upon moving heavy furniture parts, it may happen that the housing is deformed, twisted or sagged due to the occurring forces. Thereby, an undesired relative movement between the two housing walls takes place, whereby the hinge axis members of the furniture drive are displaced relative to one another and the frictional forces are massively increased. In some cases, this may eventually lead to the fact that the movable furniture part can no longer be moved or can only be sluggishly actuated due to the restraints of the furniture drive.

SUMMARY OF THE INVENTION

It is an object of the present invention a propose a furniture drive of the type mentioned in the introductory part, thereby avoiding the drawbacks as discussed above.

According to the invention, at least one supporting body is provided. The supporting body is configured so as to be separate from the at least one guide device for guiding the fastening means, at least partially surrounds the at least one guide device, and is firmly connected to the first housing wall as well as to the second housing wall, so that a movement of the second housing wall relative to the first housing wall is restrained.

In other words, at least one supporting body is provided for stabilizing the housing, and the at least one supporting body is arranged between the first and second housing wall and is firmly connected to both the first housing wall and the second housing wall. The guide device for receiving and/or guiding the fastening means is thereby at least partially surrounded by the at least one supporting body. Therefore, the guide device is stabilized by the supporting body and is largely decoupled form the remaining portions of the housing wall. In this way, the housing walls can be stabilized to one another, so that the parallel positions of the hinge axis members of the furniture drive can also be maintained to one another.

According to an embodiment, the at least one supporting body is configured so as to be V-shaped or U-shaped. The at least one supporting body can have at least two limbs forming a preferably acute angle to one another.

According to a further embodiment, the at least one supporting body surrounds the guide device over an angle range of at least 180°.

The at least one supporting body, which is preferably made of metal, can be welded, riveted or clinched to the first housing wall and/or the second housing wall.

BRIEF DESCRIPTION OF THE DRAWINGS

Further details and advantages of the invention result from the following description of figures, in which.

DETAILED DESCRIPTION OF THE INVENTION

Figure 1A:
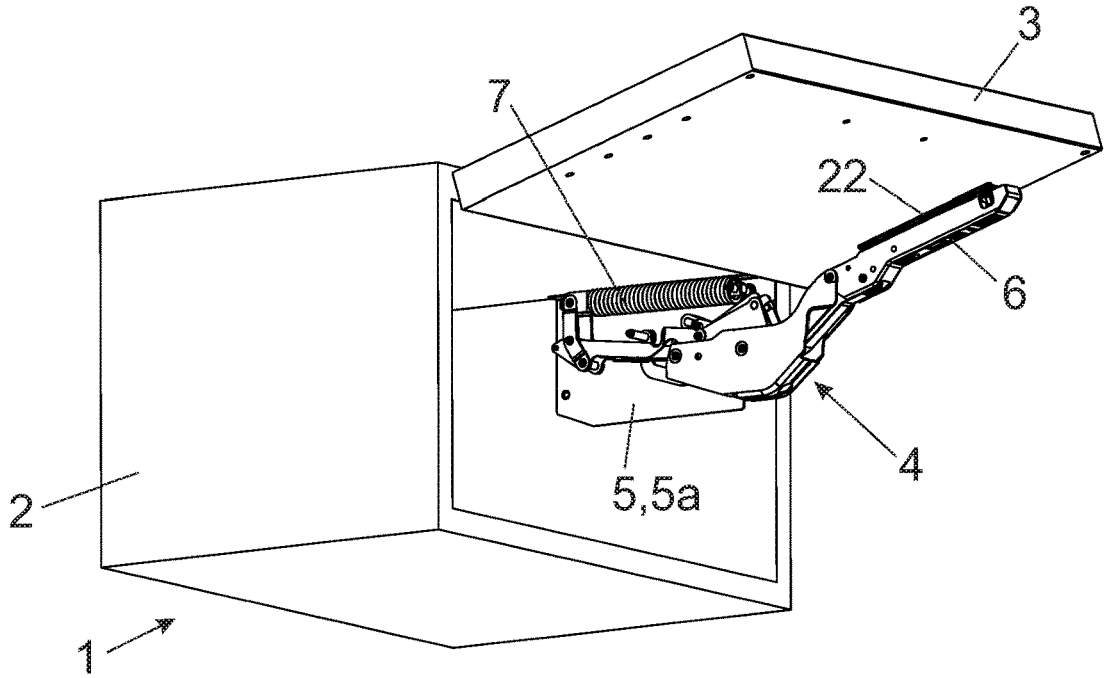
FIG. 1*a*, 1*b* show an item of furniture with a furniture part movably supported relative a furniture carcass, and a furniture drive for moving the movable furniture part.

FIG. 1*a* shows a perspective view of an item of furniture 1, in which a movable furniture part 3 is pivotally supported by a furniture drive 4 about a horizontally extending pivoting axis relative to a furniture carcass 2. By the furniture drive 4, the movable furniture part 3 can be moved from a vertical closed position into an elevated position relative to the furniture carcass 2 (and in the opposite direction). The furniture drive 4 includes a housing 5 having a first housing wall 5*a* to be fixed to the furniture carcass 2, and an actuating arm 6 configured to be pivoted relative to the housing 5 for moving the movable furniture part 3. A spring device 7 is provided for applying a force to the actuating arm 6, and the spring device 7 at least partially compensates for a weight of the movable furniture part 3. As a result, the opening movement of the movable furniture part 3 can be facilitated for an operator. By a locking device 23 (see FIG. 1*b*), the actuating arm 6 can be releasably locked to a fitting portion 22 to be fixed to the movable furniture part 3.

Figure 1B:
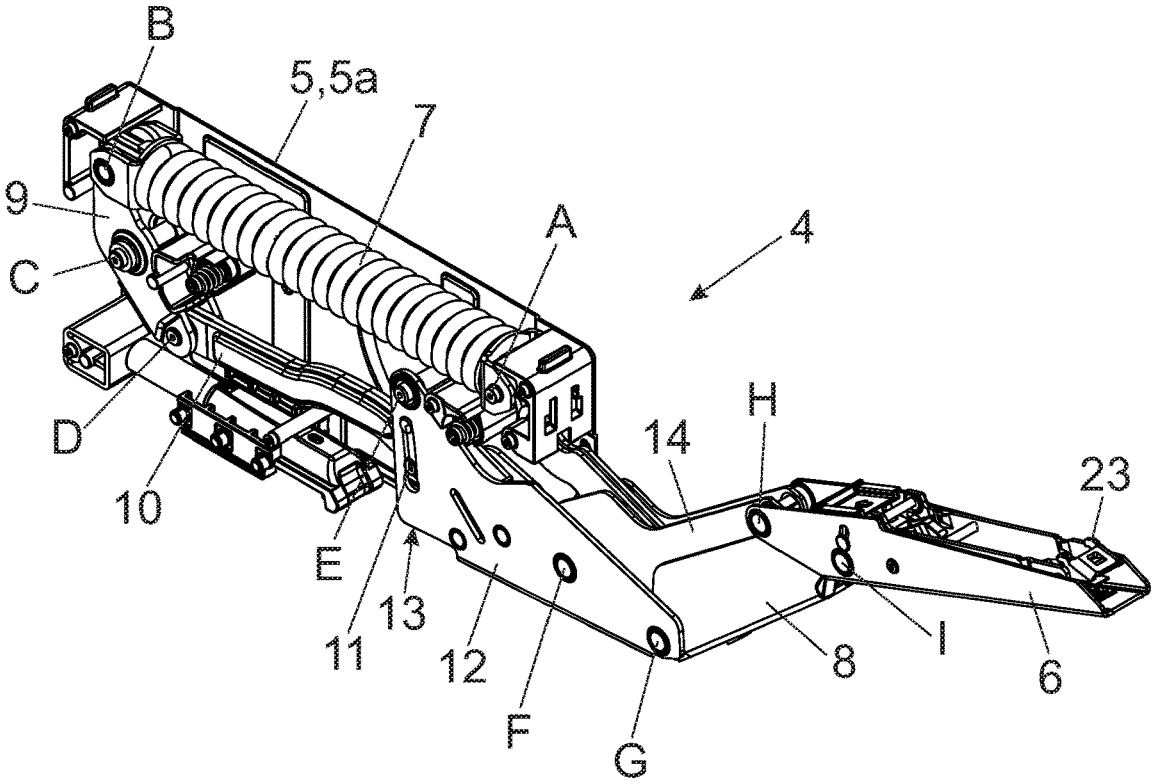

FIG. 1*b* shows the furniture drive 4 according to a possible embodiment. The spring device 7 (for example, at least one helical spring configured as a compression spring)

is supported on the first housing wall 5*a*. The spring device 7 is supported on a stationary hinge axis member A and presses against the hinge axis member B. The hinge axis member B is supported on a first lever end of a two-armed deflection lever 9, and the deflection lever 9 is pivotally mounted about the hinge axis member C. The second lever end of the deflection lever 9 is connected via the hinge axis member D to a push lever 10, and the push lever 10 is hingedly connected to a pivoting lever 12 which is pivotally mounted about the pivoting axis E. By an actuation of an adjustment device 13, the distance of a pin 11 relative to the hinge axis member E can be adjusted along a guide of the pivoting lever 12. As a result, the operative lever arm between the pin 11 and the hinge axis member E can be varied, so that a torque from the spring device 7 applied to the actuating arm 6 can be adjusted according to the respective weight of the movable furniture part 3. The pivoting lever 12 is hingedly connected to a first lever 8 and a second lever 14 via the hinge axis members F and G. The first lever 8 and the second lever 14 are hingedly connected to the actuating arm 6 via the hinge axis members H and I.

Figure 2:
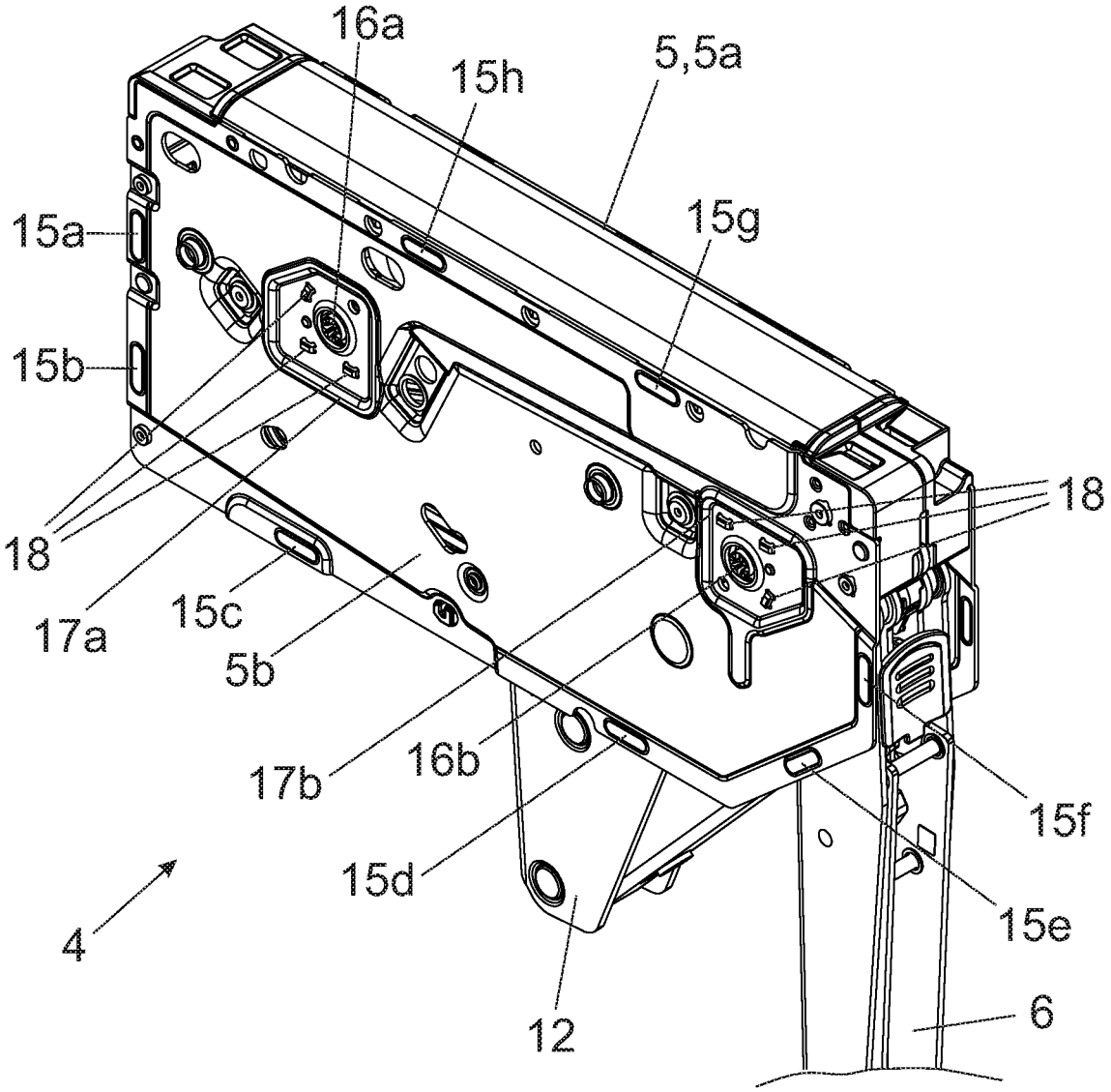
FIG. 2 shows the furniture drive in a perspective view.
Figure 3:
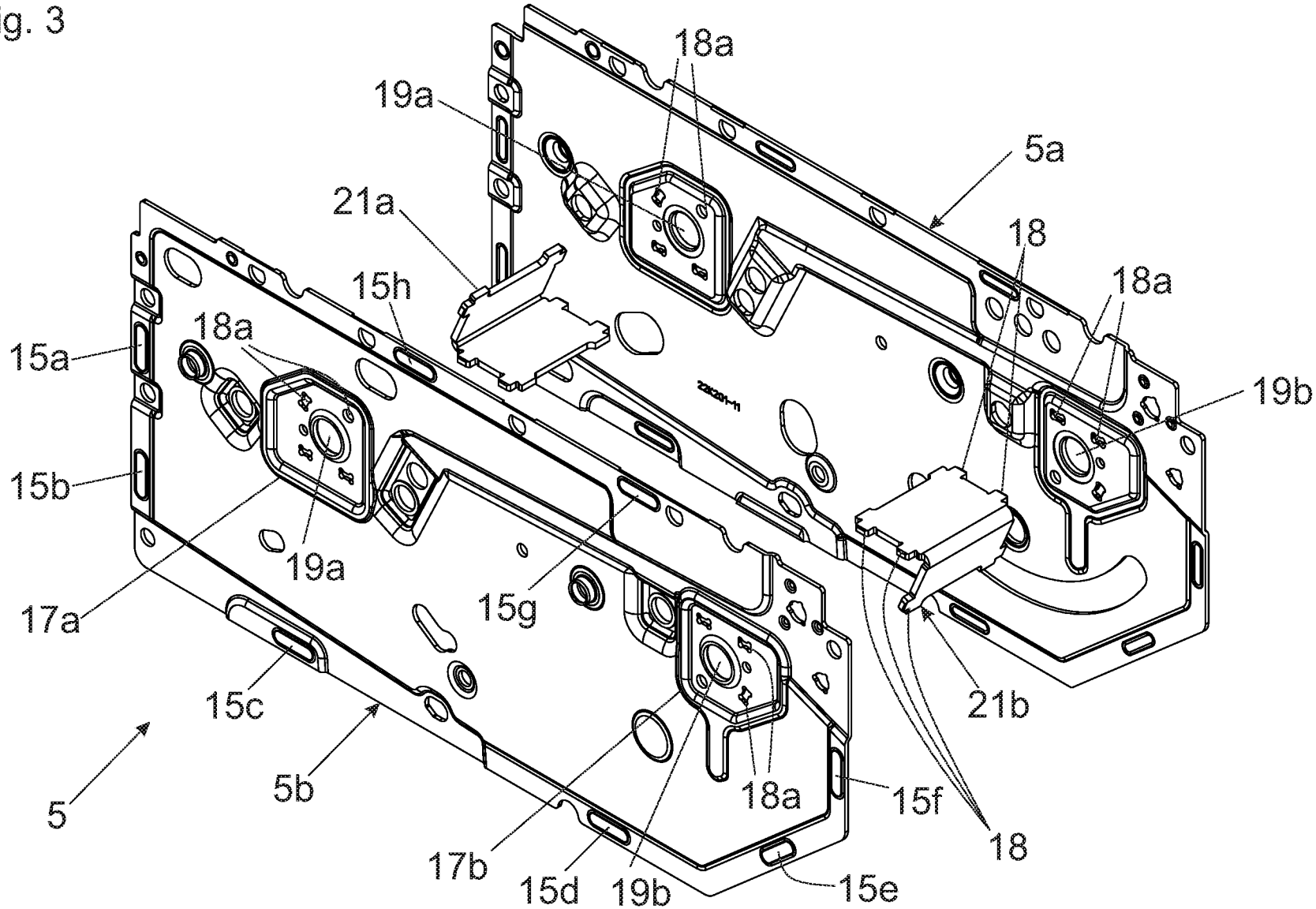
FIG. 3 shows the housing of the furniture drive in an exploded view.

FIG. 2 shows the furniture drive 4 in a perspective view. The housing 5 includes a first housing wall 5*a* configured to bear against the furniture carcass 2, and a second housing wall 5*b*. The first housing wall 5*a* and the second housing wall 5*b* are at least partially spaced from one another. By first and second fasteners 16*a* and 16*b*, for example in the form of screws, the first housing wall 5*a* can be fixed to the furniture carcass 2. The second housing wall 5*b* is held on the first housing wall 5*a* by at least one supporting body 21*a*, 21*b* or a plurality of supporting bodies 21*a*, 21*b* (FIG. 3). The housing walls 5*a*, 5*b* can be configured so as to be identical in construction apart from mirror-inverted components (i.e., mirror image), so that the comments expressed here in connection with the first housing portion 5*a* in each case do also apply for the second housing portion 5*b* (and vice versa). Such a symmetric configuration of the furniture drive 4 has the particular advantage that the furniture drive 4, in addition to a simple production, can alternatively be fixed to a left or to a right sidewall of the furniture carcass 2. Each of the housing walls 5*a*, 5*b* includes a plurality of protrusions 15*a*-15*h* spaced from each other, and the protrusions 15*a*-15*h* are configured to bear against the furniture carcass 2. Accordingly, a large part of the housing walls 5*a*, 5*b* are spaced from the furniture carcass 2 in the mounted condition of the furniture drive 4.

Visible are, preferably window-shaped, supporting rims 17*a* and 17*b* protruding from the housing walls 5*a*, 5*b* and surrounding the fasteners 16*a*, 16*b* at least partially in the mounted position. Each of the supporting rims 17*a* and 17*b* is configured to bear against the furniture carcass 2 so that the housing 5 is connected, preferably exclusively, to the furniture carcass 2 via the protrusions 15*a*-15*h* and via the supporting rims 17*a*, 17*b* in the mounted condition. Within the supporting rims 17*a*, 17*b*, fastening locations 18 of supporting bodies 21*a*, 21*b* (see FIG. 3) are arranged, and the supporting bodies 21*a*, 21*b* are firmly connected to the housing walls 5*a*, 5*b*, preferably by welding, riveting or clinching. The protrusions 15*a*-15*h* and/or the supporting rims 17*a*, 17*b* can be configured as embossings.

FIG. 3 shows the housing 5 in an exploded view. The two housing walls 5*a*, 5*b* are substantially plate-shaped and can be identical (mirror image) in construction. Visible are the protrusions 15*a*-15*h* and the supporting rims 17*a*, 17*b* by which the housing 5 can be supported on the furniture carcass 2 in the mounted condition. Each of the housing walls 5*a*, 5*b* includes at least one guide device 19*a*, 19*b* for guiding a fastener 16*a*, 16*b* (see FIG. 2), and at least one supporting body 21*a*, 21*b* is formed separately from the guide devices 19*a*, 19*b*. In the mounted position, each of the supporting bodies 21*a*, 21*b* is connected to the plate-shaped housing walls 5*a*, 5*b* and at least partially surround the guide devices 19*a*, 19*b* so that a movement of the two housing walls 5*a*, 5*b* relative to one another is prevented or restrained. In the shown embodiment, two supporting bodies 21*a*, 21*b* are provided, and the two supporting bodies 21*a*, 21*b* are spaced from each other in a longitudinal direction of the housing 5. The supporting bodies 21*a*, 21*b* are thereby formed as V-shaped profile portions, and the fastening locations 18 of the supporting bodies 21*a*, 21*b* engage in corresponding recesses 18*a* of the housing walls 5*a*, 5*b* in the mounted position.

Figure 4A:
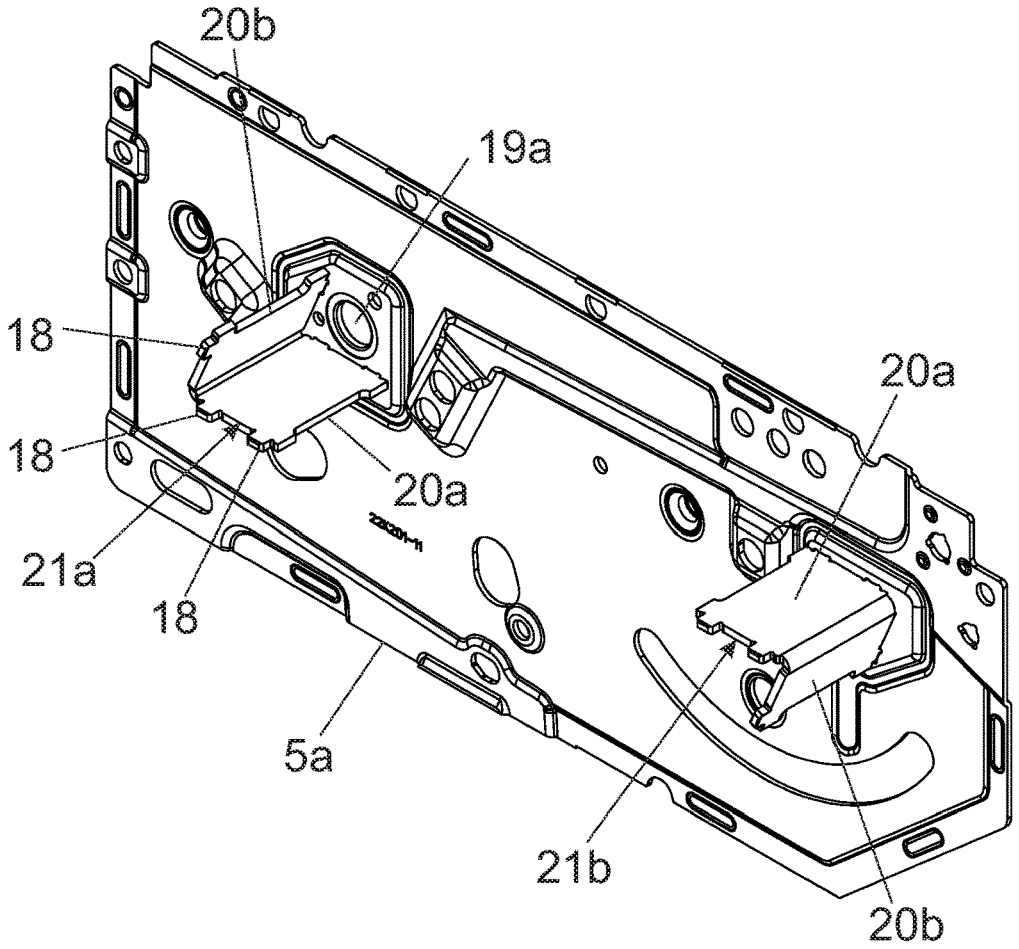
FIG. 4*a*, 4*b* show the first housing wall in a perspective view and in a side view.
Figure 4B:
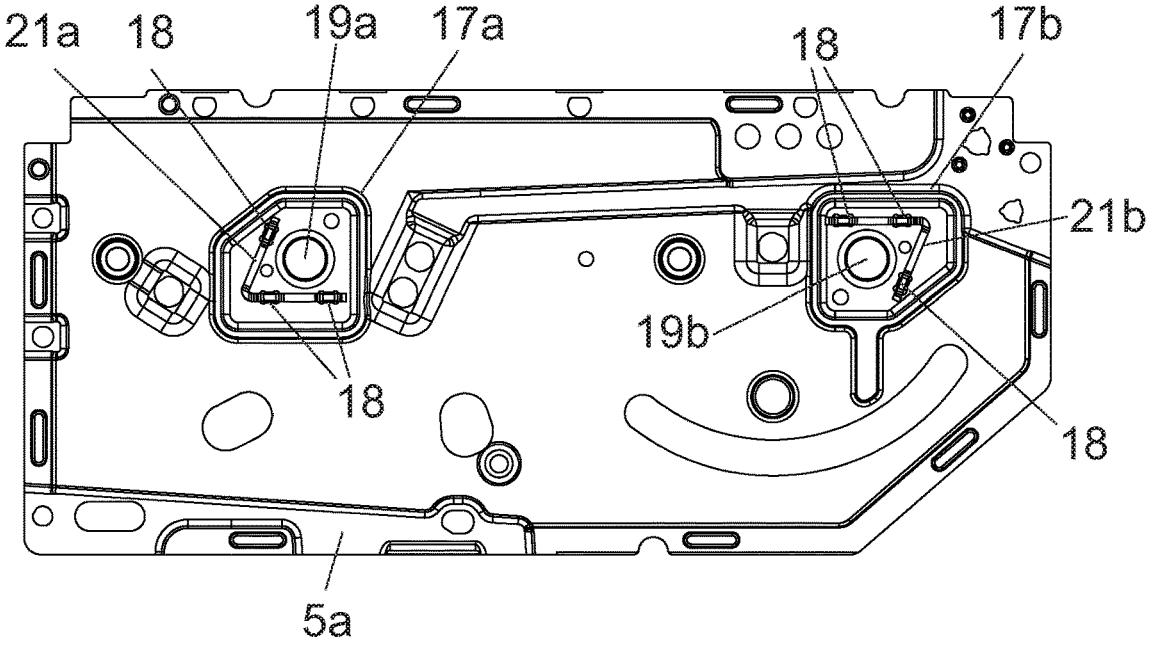

FIG. 4*a* shows the first housing wall 5*a* with the supporting bodies 21*a*, 21*b* for stabilizing the second housing wall 5*b*. Each of the supporting bodies 21*a*, 21*b* can have two limbs 20*a*, 20*b* connected to one another, and the limbs 20*a*, 20*b* form a preferably acute angle to one another. Each of the supporting bodies 21*a*, 21*b*, on a side facing towards the housing walls 5*a*, 5*b*, includes a fastening location (fastening projection) 18 engaging in the recesses 18*a* (FIG. 3) of the housing walls 5*a*, 5*b*. In the shown figure, the first supporting body 21*a* and the second supporting body 21*b* are arranged so that an orientation of each supporting body is offset relative to the other by 180° (i.e., as shown in FIGS. 4*a* and 4*b*, one limb of the first supporting body 21*a* is located above the corresponding guide device 19*a*, while one limb of the second supporting body 21*b* is located below the corresponding guide device 19*b* such that the orientations of the supporting bodies 21*a*, 21*b* are offset by) 180°. Thus the second housing wall 5*b* can be stabilized relative to the first housing wall 5*a* in a plurality of movement directions.

FIG. 4*b* shows a side view of the first housing wall 5*a*, in which the arrangement of the first and second supporting body 21*a*, 21*b* relative to the guide devices 19*a*, 19*b* is shown in greater detail. The fastening locations (fastening projections) 18 of the supporting bodies 21*a*, 21*b* are thereby arranged with a distance as large as possible relative to a middle axis of the guide devices 19*a*, 19*b*, whereby an improved moment of resistance is brought about when the furniture drive 4 is loaded. Each of the supporting rims 17*a*, 17*b* can be configured as an embossing, whereby the risk of a deformation of the housing walls 5*a*, 5*b* can be reduced upon screwing to the furniture carcass 2. In the shown figure, the fastening locations 18 of the supporting bodies 21*a*, 21*b* are arranged in a, preferably equilateral, triangle, so that the furniture drive 4 is suitable for receiving high loads due to the shown triangular support.

Figure 5A:
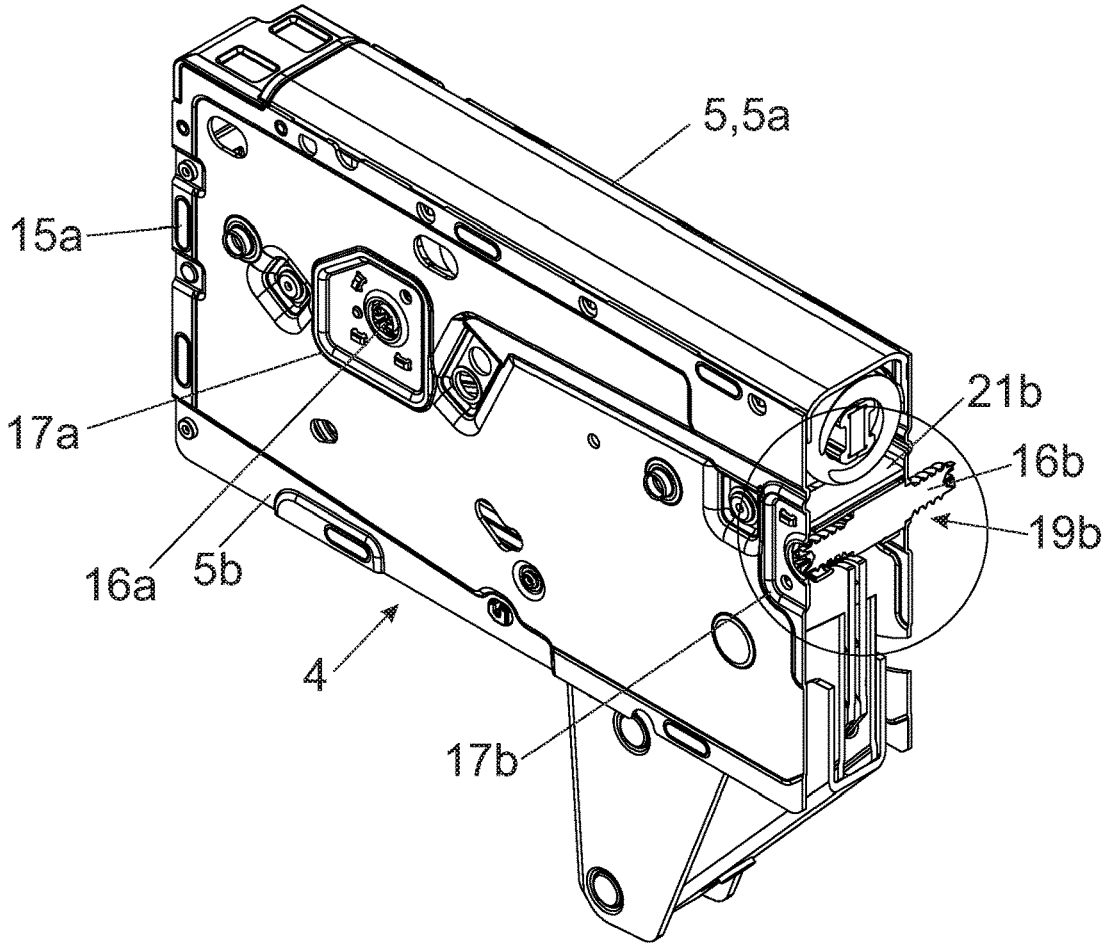
FIG. 5*a*, 5*b* show a cross-sectional view of the furniture drive and an enlarged detail view thereof.
Figure 5B:
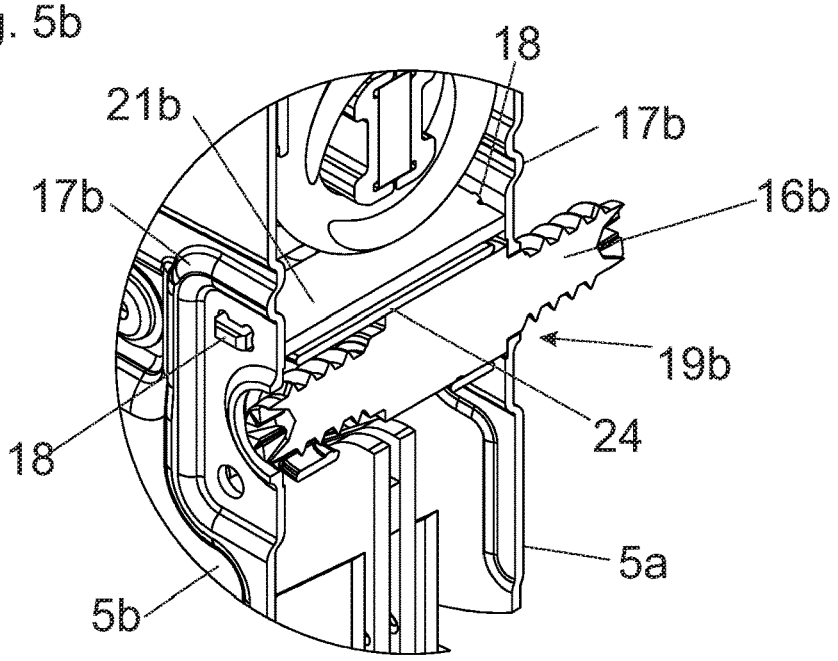

FIG. 5*a* shows a cross-sectional view of the furniture drive 4, while FIG. 5*b* shows the encircled region of FIG. 5*a* in an enlarged view. The guide device 19*b* for receiving and/or guiding the fastener 16*b*, preferably a screw, can have a two-part or a multi-part configuration, and additionally includes a cylindrical portion 24 (FIG. 5*b*), for example in the form of a sleeve, for guiding the fastener 16*b*. The supporting body 21*b* is configured so as to be separate from that guide device 19*b*. In other words, the supporting body 21*b* is not provided for guiding the fastener 16*b* and is therefore configured so as not to contact the guide device 19*b*. Visible are the fastening locations (fastening projections) 18 of the supporting body 21*b*, the fastening locations 18 being firmly connected to the first housing wall 5*a* on the one hand and to the second housing wall 5*b* on the other hand. Further visible are the transversely protruding supporting rims 17*b* for stabilizing the housing walls 5*a*, 5*b*, and the supporting rims 17*b* may be produced by an embossing operation for example. The first housing wall 5*a* is to be fixed to the furniture carcass 2 by the fastener 16*a*, 16*b*. The second housing wall 5*b*, on the contrary, is supported on the first housing wall 5*a* by at least one or a plurality of supporting bodies 21*a*, 21*b*.

The invention claimed is:

1. A furniture drive for moving a furniture part movably supported relative to a furniture carcass, the furniture drive comprising:

a housing having a first housing wall to be fixed to the furniture carcass, and a second housing wall at least partially spaced from the first housing wall, the first housing wall including a guide device for guiding a fastener; and a supporting body separate from the guide device for guiding the fastener, the supporting body at least partially surrounding the guide device and being firmly attached to both the first housing wall and the second housing wall so that a movement of the second housing wall relative to the first housing wall is restrained, wherein the first housing wall has a protruding supporting rim formed therein, the supporting rim being configured to bear against the furniture carcass and to at least partially surround the guide device.

2. The furniture drive according to claim 1, wherein the supporting body includes at least two limbs connected to one another to form an angle to one another.

3. The furniture drive according to claim 1, wherein the supporting body surrounds the guide device over an angle range of at least 180°.

4. The furniture drive according to claim 1, wherein the at least one supporting body is welded, riveted, or clinched to at least one of the first housing wall and the second housing wall.

5. The furniture drive according to claim 1, wherein the supporting body includes a fastening protrusion engaging in a corresponding recess of one of the first housing wall and the second housing wall.

6. The furniture drive according to claim 5, wherein the supporting body includes at least two fastening protrusions, the at least two fastening protrusions including a first fastening protrusion engaging in a corresponding first recess of the first housing wall, and a second fastening protrusion engaging in a corresponding second recess of the second housing wall.

7. The furniture drive according to claim 1, wherein the supporting body consists of a metallic material.

8. The furniture drive according to claim 1, wherein the guide device is entirely surrounded by the supporting rim protruding from the first housing wall.

9. The furniture drive according to claim 1, wherein the supporting body is at least partially arranged within the supporting rim.

10. The furniture drive according to claim 1, wherein the guide device is a first guide device and the supporting body is first supporting body, the first housing wall including a second guide device for guiding a second fastener, and a second supporting body at least partially surrounds the second guide device.

11. The furniture drive according to claim 10, wherein the first supporting body and the second supporting body are arranged such that an orientation of the first supporting body is offset relative to an orientation of the second supporting body by 180°.

12. The furniture drive according to claim 1, wherein at least one of the first housing wall and the second housing wall includes a plurality of protrusions configured to bear against the furniture carcass, and the protrusions are spaced from one another.

13. The furniture drive according to claim 1, wherein the first housing wall and the second housing wall are formed to be mirror images of each other.

14. The furniture drive according to claim 1, wherein the furniture drive further comprises a pivotally mounted actuating arm for moving the movable furniture part, and a spring device for applying a force to the actuating arm.

15. The furniture drive according to claim 2, wherein the limbs of the supporting body form an acute angle to one another.

16. The furniture drive according to claim 1, wherein the supporting body is entirely arranged within the supporting rim.

17. An item of furniture comprising:

a furniture carcass;

a furniture part movably supported relative to the furniture carcass; and a furniture drive for moving the movable furniture part, the furniture drive comprising:

a housing having a first housing wall to be fixed to the furniture carcass, and a second housing wall at least partially spaced from the first housing wall, the first housing wall including a guide device for guiding a fastener; and a supporting body separate from the guide device for guiding the fastener, the supporting body at least partially surrounding the guide device and being firmly attached to both the first housing wall and the second housing wall so that a movement of the second housing wall relative to the first housing wall is restrained, wherein the first housing wall has a protruding supporting rim formed therein, the supporting rim being configured to bear against the furniture carcass and to at least partially surround the guide device.

* * * * *